US006640886B2

(12) United States Patent
Lamich

(10) Patent No.: US 6,640,886 B2
(45) Date of Patent: Nov. 4, 2003

(54) HEAT EXCHANGER TUBE, HEAT EXCHANGER AND METHOD OF MAKING THE SAME

(75) Inventor: Bernhard Lamich, Esslingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/198,224

(22) Filed: Jul. 18, 2002

(65) Prior Publication Data

US 2003/0024694 A1 Feb. 6, 2003

(30) Foreign Application Priority Data

Jul. 31, 2001 (DE) ..... 101 37 334

(51) Int. Cl.[7] ..... F28F 9/02

(52) U.S. Cl. ..... 165/174; 165/177; 165/183; 138/38; 29/890.053; 29/890.049

(58) Field of Search ..... 165/109.1, 181, 165/174, 176, 177, 178, 183, 133; 29/890.052, 890.053, 890.054, 890.046, 890.049; 138/115, 117, 170, 171, 38, 163

(56) References Cited

U.S. PATENT DOCUMENTS 2,757,628 A * 8/1956 Johnston ..... 29/890.047
4,805,693 A * 2/1989 Flessate ..... 165/153
5,036,909 A * 8/1991 Whitehead et al. ..... 165/133
5,185,925 A * 2/1993 Ryan et al. ..... 29/890.049
5,186,250 A * 2/1993 Ouchi et al. ..... 165/177
5,979,051 A 11/1999 Kato et al.
5,996,633 A * 12/1999 Kato ..... 138/38
6,192,977 B1 2/2001 Dey et al.
6,267,177 B1 * 7/2001 Shinhama et al. ..... 165/177

FOREIGN PATENT DOCUMENTS

| | | |
|---|---|---|
| DE | 3743293 | 6/1989 |
| EP | 0907062 | 4/1999 |
| FR | 2147868 | 3/1973 |
| FR | 2769359 | 4/1999 |
| GB | 683161 | 11/1952 |
| WO | 9400726 | 1/1994 |

* cited by examiner

*Primary Examiner*—Terrell McKinnon
(74) *Attorney, Agent, or Firm*—Wood, Phillips, Katz, Clark & Mortimer

(57) ABSTRACT

An economically formed tube of rectangular or oval-like cross section and with a corrugated internal fin includes spaced, relatively long side wall sections joined at their ends by relatively short end wall sections. An integral fin within the tube has crests and valleys defining a plurality of flow paths within the tube and is formed of a corrugated section of a strip employed to form one of the side walls and at least part of both of the end walls.

21 Claims, 6 Drawing Sheets

Fig. 6
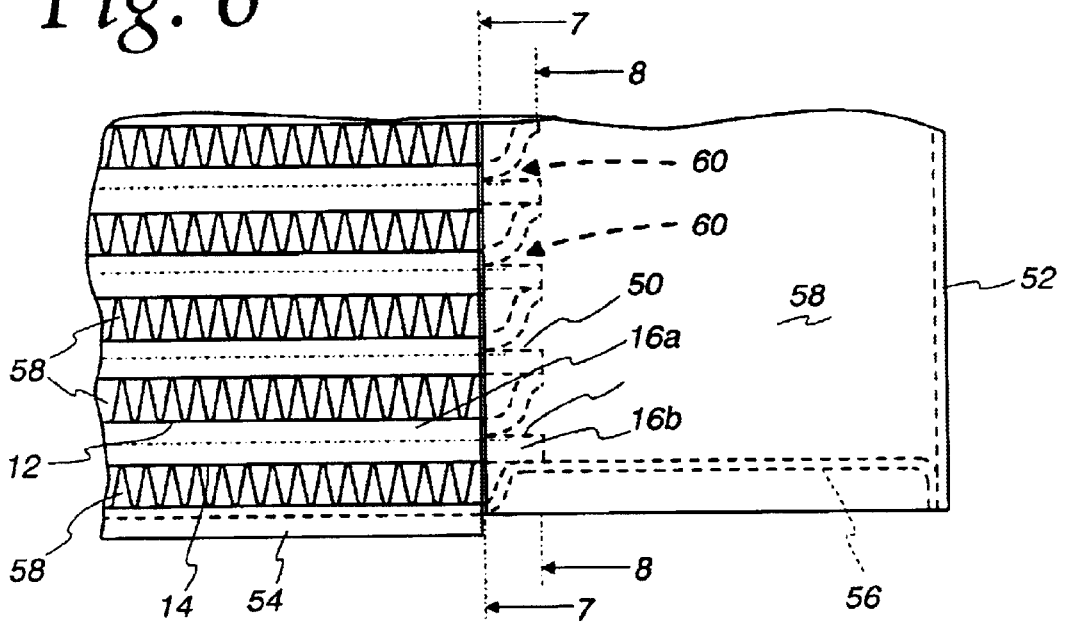
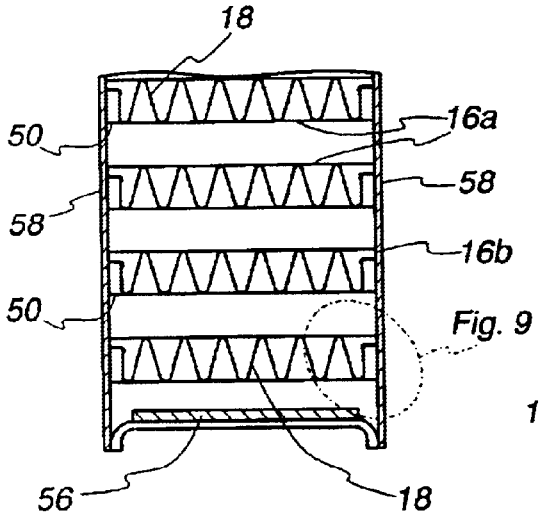
Fig. 7
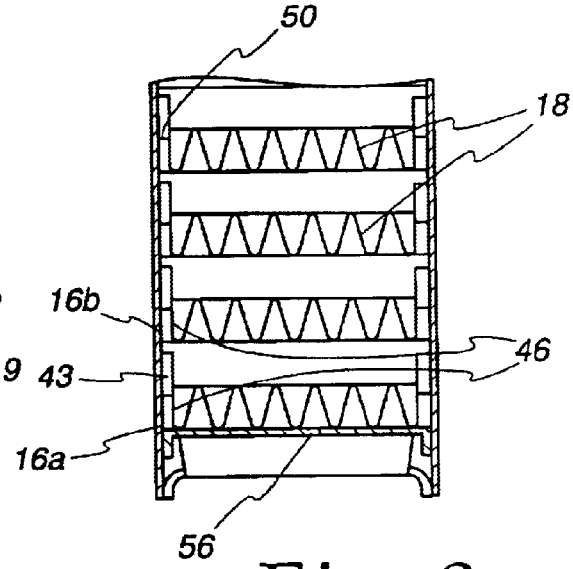
Fig. 8
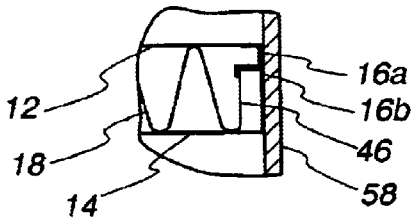
Fig. 9

HEAT EXCHANGER TUBE, HEAT EXCHANGER AND METHOD OF MAKING THE SAME

FIELD OF THE INVENTION

This invention relates to heat exchangers, and more particularly, to a flat tube for heat exchangers that may be made by forming an elongated strip. It also relates to heat exchangers utilizing such tubes and methods of fabricating the tubes.

BACKGROUND OF THE INVENTION

Many heat exchangers in use today include so-called flattened tube which are variously described as flattened tubes and/or oval tubes. Many of these tubes include internal fins which divide the interior into a plurality of flow channels. These internal fins typically, but not always, provide pressure resistance to the interior of the tube by interconnecting opposed flat walls of the tube. They also increase heat transfer. In the usual case, the fin will be a much better heat conductor than the fluid passing through the tube with the consequence that the fin readily conducts heat from the fluid impinging against it to the side wall of the tube whereat heat exchange occurs with some other fluid.

A flat tube of this general type is disclosed in European Patent EP 646231. However, this type of tube is not particularly adapted for use in heat exchangers without headers or tube sheets. However, the tubes of the '231 European patent are unsuitable for slitting and bending at their ends in order to provide intake funnels at the enlarged ends to input and avoid use of headers as disclosed in German Patent Application DE 100 16 113.8.

Other types of flat tubes are known. For example, in U.S. Pat. No. 4,805,693, a flat tube is disclosed which must be assembled from three different parts. The ends of the tube of the '693 U.S. patent cannot be slit and bent to form an intake funnel because the part forming one flat side of the flat tube partially embraces or encloses the part forming the other flat side.

Still another flat tube is disclosed in European Patent Application EP 907062 and consists of two parts. However, this tube has no internal fin to form a number of flow channels in the interior of the tube and consequently, one must either insert an internal fin, leading to an increase in construction expense, or do without the advantages of internal fins. Similar drawbacks are associated with the flat tube disclosed in United Kingdom Patent 683161 of Nov. 26, 1952.

The present invention is intended to provide a flat tube that can be produced with cost effectiveness and can be slit and bent, if desired, on the ends so as to be employed in headerless heat exchangers and which may be additionally used in heat exchangers with headers and which includes an internal fin and provides the advantages thereof.

SUMMARY OF THE INVENTION

It is the principal object of the invention to provide a new and improved flat tube for use in heat exchanger and which contains an internal fin. It is also an object of the invention to provide a heat exchanger having such tubes as well as a method of producing such tubes.

An exemplary embodiment of the invention, in one aspect thereof, provides a flattened tube for use in a heat exchanger and which has two spaced relatively long side walls connected at their ends by two spaced relatively short end walls to provide a generally rectangular or oval-like cross section. An internal fin extends between the side walls within the tube to provide a plurality of internal flow channels within the tube. The invention contemplates the improvement wherein the tube includes two pieces, each including a corresponding one of the side walls, with at least one of the pieces including at least a portion of each of the end walls. A first of the pieces includes an integral, corrugated section defining the internal fin which is folded back into abutment with the side wall of the first piece. A second of the side pieces has its side wall abutting the corrugated section opposite of the side wall of the first piece. The pieces are sealingly bonded to each other at the end walls with the side walls of both the pieces being bonded to the corrugated section within the cross section of the tube itself.

In a preferred embodiment, at least one of the pieces includes a mating formation that mates with part of the other of the pieces to hold the pieces together during brazing. In this embodiment of the invention, it is preferred that the pieces be braze clad aluminum and that the bonding is provided by a braze joint.

One embodiment of the invention contemplates that both of the pieces have portions of the end walls and are bonded to each other at joints located noncentrally in the end walls with the cross sections of the tube being generally rectangular.

In the embodiment mentioned in the preceding paragraph, it is highly preferred that the joints be located closer to the second piece side wall than to the first piece side wall.

Another embodiment of the invention contemplates that the pieces are bonded together by joints located generally centrally of the end walls and that the end walls be outwardly convex to form a tube of oval-like cross section.

In one embodiment of the invention, the pieces are made of elongated metal strips and the end walls have a thickness double the thickness of the strips.

One embodiment of the invention contemplates that the pieces are bonded to each other by joints with the joints being defined by generally U-shaped formations on one of the pieces along with folded edges on the other of the pieces. Legs of the U-shaped formation abut the folded edges.

According to the invention, in another facet thereof, there is provided a heat exchanger including a pair of spaced header plates. Each of the plates has tube slots therein which are aligned with the tube slots in the other plate and a plurality of tubes made according to any of the preceding paragraphs and having opposed ends are disposed and sealingly bonded in the aligned ones of the tube slots.

According to still another embodiment of the invention, a heat exchanger includes a plurality of tubes made as stated above and aligned with their side walls facing each other in spaced relation. Serpentine fins extend between and are bonded to the facing side walls of adjacent tubes and the second piece of each tube, at its ends, has its end walls split and deflected away from the first piece of the same tube. The side wall of each first piece sealingly engages a deflected end of the second piece of an adjacent tube and a channel shaped tank is fit over and sealingly engages and is bonded to the deflected ends of the second pieces and the end walls of both of the pieces from the ends of the tubes to a location where the end walls are not split.

The invention, in still another facet thereof, contemplates a method of making a tube of rectangular or oval cross section and having an internal fin. The method includes the steps of (a) providing first and second elongated strips of good thermally conductive material, (b) forming the first strip to have a flat side wall section, two spaced tube end wall sections and a corrugated section disposed between the side wall section and one of the end wall sections, (c) bending the strip to bring the corrugated section into aligned abutment with the side wall section, (d) locating the second strip on the first strip in abutment with the corrugated section and with the end wall sections, and (e) bonding the second strip to the end wall sections in sealed relation and to the corrugated section.

According to one preferred embodiment of the method, step (d) is preceded by the additional step of forming the second strip into a generally central side wall section located between two end wall sections and step (d) is performed by abutting the second strip end wall sections with the first strip end wall sections.

The inventive method also includes, as part of a preferred embodiment, the sequence wherein step (b) includes the step of forming a second corrugated section between the first strip side wall section and the other of the first strip end wall sections and that step (c) is performed on both of the corrugated sections.

In a preferred embodiment of the invention, the forming of the first strip end wall section according to step (b) is accomplished by bending the strip at each edge of the side wall section to approximately a right angle thereto, and at an edge of each end wall section remote from the first strip side wall section, forming a reentrant tongue so that the reentrant tongue on each first strip end wall sections are directed towards each other.

Preferably, step (d) is preceded by the step of bending opposite edges of the second strip to form retention tongues directed toward the first piece end wall sections and step (d) includes fitting the retention tongues in interfering relation to the first strip end wall section prior to the performance of step (e).

This step may include lodging the retention tongues against the reentrant tongues in interference relation.

Other objects and advantages will become apparent from the following specification taken in connection with the accompanying drawings.

DESCRIPTION OF THE DRAWINGS

FIG. 6 is an enlarged, fragmentary view of part of the heat exchanger of FIG. 4;

FIG. 7 is a fragmentary, sectional view taken approximately along the line 7—7 in FIG. 6;

FIG. 8 is a fragmentary, sectional view taken approximately along the line 8—8 in FIG. 6;

FIG. 9 is an enlarged, fragmentary view taken within the circle 9 in FIG. 7;

DESCRIPTION OF THE PREFERRED EMBODIMENTS

The invention is ideally suited for providing a tube for use in so-called charge air coolers which are heat exchangers employed between the outlet of a supercharger or a turbocharger and the intake manifold of an internal combustion engine. Thus, a typical usage of the invention is in a gas to gas heat exchanger. However, except to the extent stated in the appended claims, no limitation to such a usage is to be implied nor is it intended. Those skilled in the art will readily appreciate that the tubes of the invention and heat exchangers utilizing them can be employed with efficacy and other applications including liquid/liquid heat exchangers, gas/liquid heat exchangers, and even in two phase heat exchangers wherein condensation or evaporation is occurring within or without the tubes. With the foregoing in mind, attention is now directed to FIG. 1.

Figure 1:
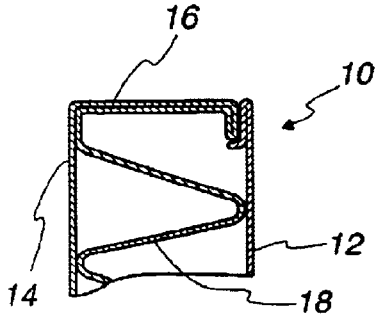
FIG. 1 is a fragmentary, sectional view of one form of rectangular tube made according to the invention.

FIG. 1 shows one form of a flat tube made according to the invention. The tube is shown fragmentarily and it will be appreciated that its length from top to bottom is considerably greater than that shown. The tube is generally designated 10 and includes opposed, spaced relatively long side walls 12, 14 having their ends connected by relatively short end walls 16 (only one of which is shown). Within the tube is a corrugated, undulating or sinusoidal insert 18 which is bonded to the interior of both of the side walls 12 and 14. The tube 10 has a rectangular cross section.

Figure 1A:
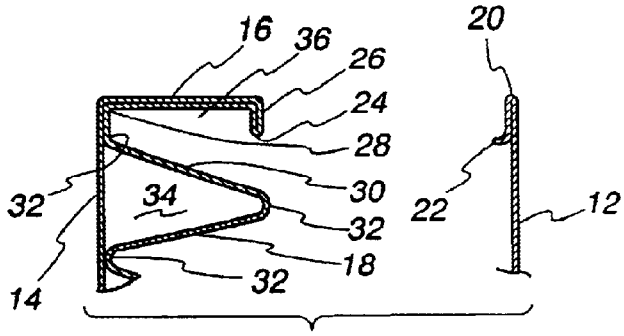
FIG. 1A is a fragmentary exploded view of the tube of FIG. 1.

In the embodiment shown in FIG. 1 and FIG. 1A, and with particular reference to FIG. 1A, the tube 10 is seen to include two parts, one including the side wall 12 and the other including both the side wall 14 and the end walls 16.

The two pieces or parts are made from elongated strips, preferably braze clad aluminum, although other thermally conductive materials, even including non-metals can be used in forming the strips. Turning to the strip containing the side wall 12, at both ends, it is doubled upon itself as shown by a bend 20. The ultimate edge of the strip is directed at approximately 90°, inwardly as shown at 22, toward the side wall 14.

The strip forming the side wall 14 has the end wall 16 bent at right angles upon itself to form the end wall 16. At a bend 24 in the strip, a reentrant tongue 26 is formed and is directed generally parallel to the side wall 14 and toward a similar reentrant tongue 26 on the opposite end of the strip. The strip continues inwardly to form part of the side wall 16 and then is bent as at 28 to abut, in parallel fashion, the side wall 14 for a short distance before being bent into corrugations 30 forming the internal fin 18. The corrugations 30 have opposed peaks 32 and valleys 34 forming a plurality of flow channels 34 equal to the number of corrugations 30 plus an additional flow path 36 at each end. A reentrant tongue 22 on the strip forming the side wall 12 serves as a retaining tongue and is sized to engage the reentrant tongue 26 at the bend 24 in a slight interference relation so as to hold two pieces together during assembly and prior to bonding. The arrangement is such that the peaks 32 of the corrugations 30 engage, in alternating fashion, from top to bottom of the tube as viewed in FIGS. 1 and 1A, the interiors of the side walls 14 and the interiors of the side wall 12 and are bonded thereto. Preferably, the bonds extend along the entire length of the peaks 32 although that is not necessary. Such full length bonding does provide superior strength against bulging of the tube 10 due to internal pressure when in use.

Figure 2:
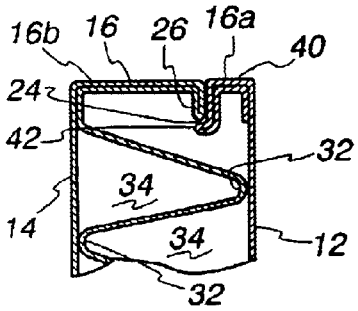
FIG. 2 is a view similar to FIG. 1 but of another embodiment of the invention.
Figure 2A:
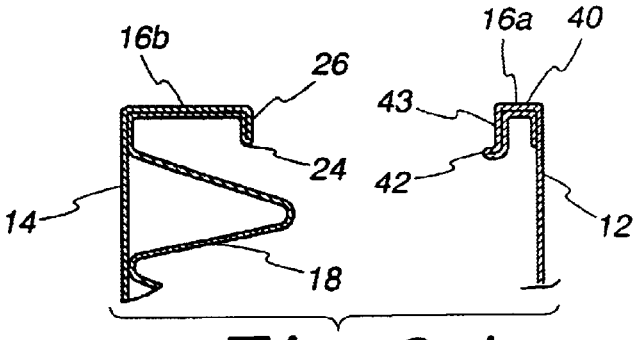
FIG. 2A is a fragmentary exploded view of the tube of FIG. 2.

A second tube embodiment is illustrated in FIGS. 2 and 2A and where like components are employed, like reference numerals are used and those parts will be not be redescribed except as necessary to provide a full understanding. In the embodiment of FIG. 2, the edges of the strip 12 are folded to define a double thickness, U-shaped structure 40 which terminates in a double thickness reentrant retaining tongue 42 which is directed at right angles to the side wall 12 and toward the side wall 14. A leg 43 of the U-shaped structure 40 and having the retaining tongue 42 thereon is generally parallel to both of the side walls 12 and 14 as is a side of the reentrant tongue 26. These two are abutted together and bonded sealingly to one another. The strip including the side wall 14 may be formed generally identically to that described in connection with the description of FIGS. 1 and 1A except that in the case of the tube shown in FIG. 2, the side wall 16 is defined by two sections 16*a* and 16*b*, the former being part of the strip having the side wall 12 and the latter being part of the strip having the side wall 14. Again, the retention tongue 42 is intended to interference fit against the bent end 24 of the reentrant tongue 26 to hold the parts in assembled relation during bonding or the like.

It is to be particularly noted that in the embodiment shown in FIGS. 2 and 2A, the split between the side wall part 16*a* and 16*b* occurs noncentrally and is closer to the side wall 12 than to the side wall 14. This serves a purpose in terms of optimizing the resulting tube for use in a headerless heat exchanger.

Figure 3:
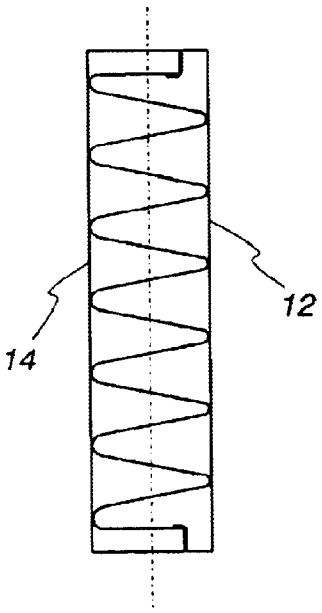
FIG. 3 is a somewhat schematic view of still another form of tube made according to the invention.
Figure 3A:
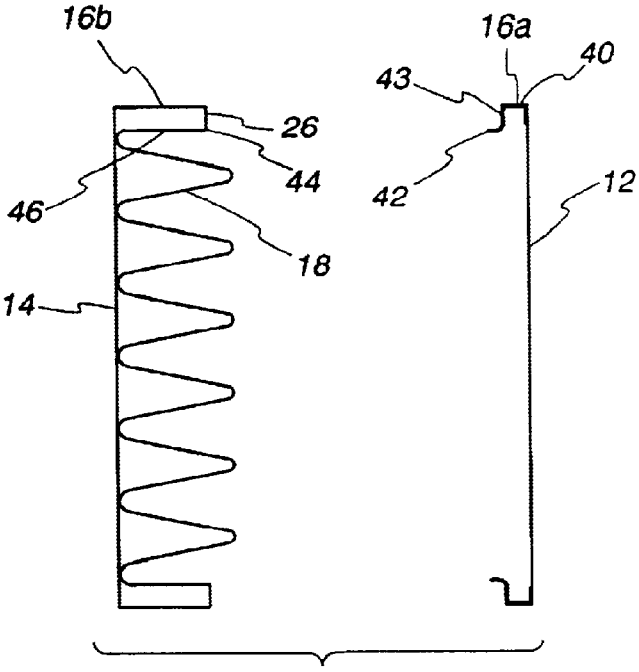
FIG. 3A is an exploded view of the tube of FIG. 3.

FIGS. 3 and 3A show still another form of the tube. The piece containing the side wall 12 may be formed identically to that shown in FIG. 2A, i.e. with a doubled thickness U-shaped structure 40. Alternatively, the same may only be single thickness if desired.

On the other hand, in the embodiment shown in FIGS. 3 and 3A, the side wall part 16*b* is not double thickness and in lieu of a 180° bend 24, a 90° bend 44 is provided on the reentrant tongue 26. Consequently, the internal fin 18 has a section 46 at each end which is generally a right angles to the side wall 14. The tube shown in FIGS. 3 and 3A is likewise ideally suited for use in a headerless heat exchanger.

Figure 4:
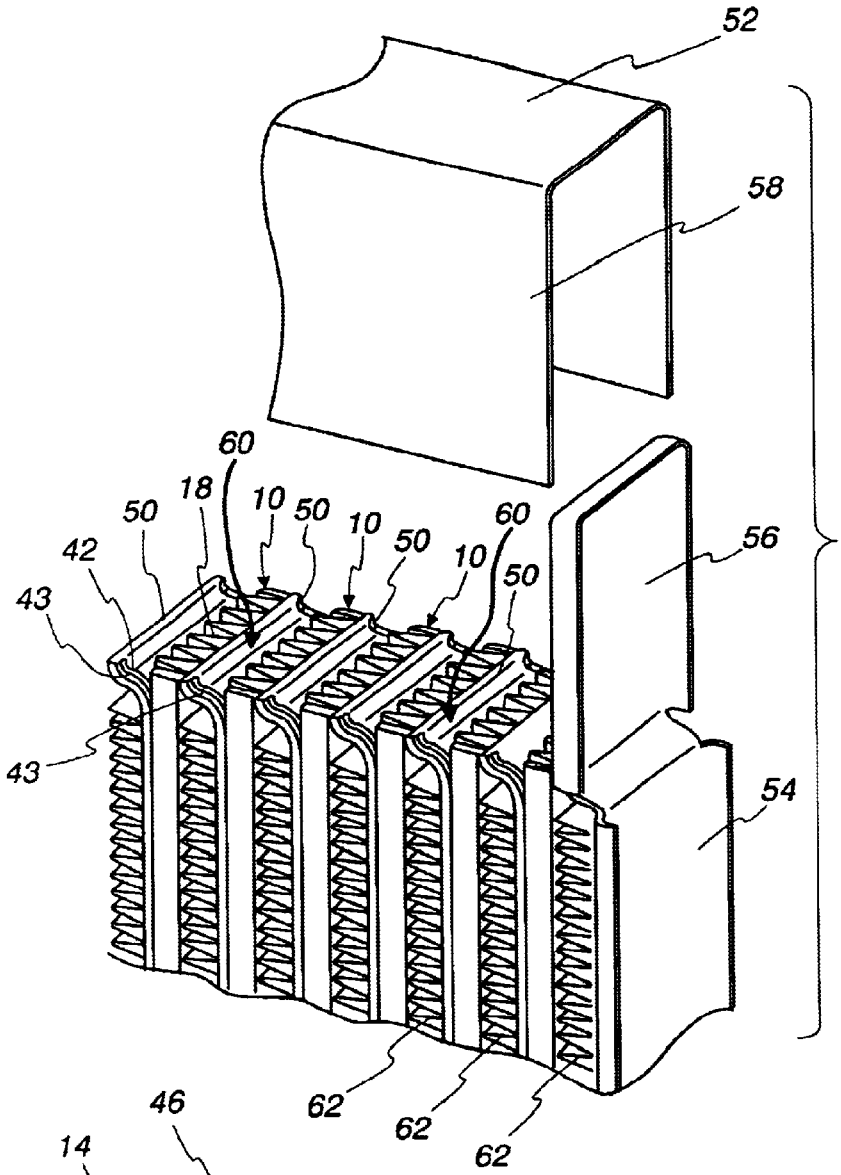
FIG. 4 is a fragmentary exploded view of a headerless heat exchanger embodying tubes made according to the invention.
Figure 5:
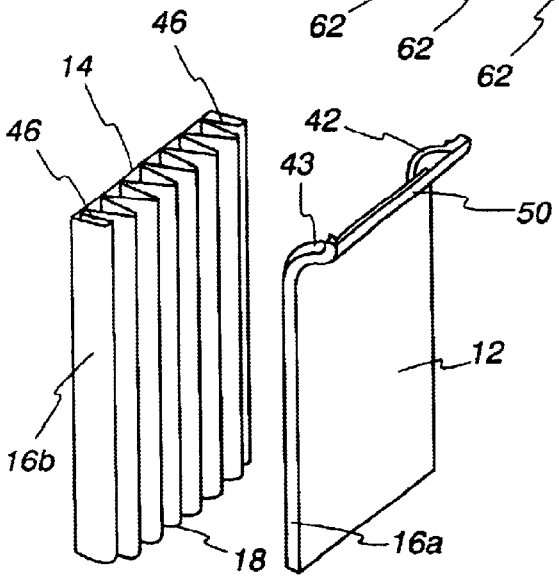
FIG. 5 is a fragmentary, exploded view of one of the tubes employed in the heat exchanger of FIG. 4.

Turning now to FIGS. 4 and 5, a heat exchanger is shown fragmentarily and is of the headerless type. The tube of FIGS. 3 and 3A is employed, although the tube of FIGS. 2 and 2A could be readily interchanged therewith. In certain applications, where low internal tube pressure is present, the tube of FIGS. 1 and 1A could also be used. As can be seen in FIG. 4, the ends of each of the tubes 10 are split by deflecting the end part of the strip having the side wall 12 into an S-shaped configuration that is spaced, and unbonded to the corrugated internal fin 18 near the ends thereof. This split, deflected end is given the reference numeral 50 that the same is brought into contact with the undeformed, planar end of the side wall 14 of an adjacent one of the tubes 10 and sealingly bonded thereto. The split 50 may be cut in the side wall 16 if desired but preferably is simply part of the seam between the end wall parts 16*a* and 16*b*. A channel-like tank 52 and an end piece 54 having a tank end section 56 are provided. The end piece 54 sandwiches a conventional serpentine fin 58 against the side wall 14 of the endmost one of the tubes 10 while the tank end piece 56 fits snugly within the end of the channel 52. The legs 58 of the channel 54 are such as to extend downwardly past the deflected ends and the split 50 of the various tubes 10 to a point where the legs 58 abut the undeformed portions of the side wall 16*a* and 16*b* of the tubes of FIGS. 2 and 2A and 3 and 3A or the bend 20 of the tube of FIGS. 1 and 1A where used and they are bonded and sealed thereto. Consequently, each tube 10, at each end, contains a funnel-like formation, generally designated 60, for receipt or discharge of a heat exchange fluid flowing within the tube into the interior of the tank 52 without the provision of a header to receive the ends of the tubes. However, the tubes may be used in heat exchangers with headers in a conventional fashion. In such heat exchangers, spaced header plates are provided with the line tube receiving holes therein and the undeformed ends of the tubes, that is, tubes without the S-shaped deformation in the strip having the side wall 12 is not present are fitted into the aligned tube holes in opposing ones of the headers.

In addition, serpentine fins 62 are sandwiched between adjacent ones of the tubes 10 at locations intermediate the deformed ends and splits 50. They are typically bonded to the facing side walls 12, 14 of adjacent tubes.

Figure 10:
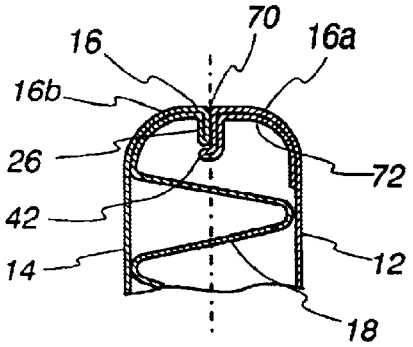
FIG. 10 a view like FIG. 1 but showing an oval-like cross section tube.
Figure 10A:
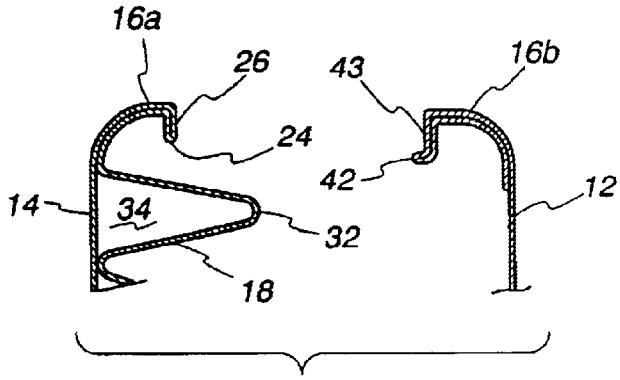
FIG. 10A is an exploded view of the tube of FIG. 10.

FIGS. 10 and 10A show a form of a tube having an oval-like cross section, i.e., the side walls 16 are radially convex. This embodiment is formed generally similarly to the embodiment shown in FIGS. 2 and 2A except that the bond line between the side walls 16 and 16*b* is centrally located as indicated at 70. Again, a retention tongue 42 is provided on a channel-like section 72 of the strip having the side wall 12 which corresponds approximately to the U-shaped configuration 40. Similarly, the reentrant tongue 28 on the strip having the side wall 14 is retained and again, an interference fit is provided so as to hold the two components of the tube together during assembly.

The pieces defining the strips having the side walls 12, with or without the end wall 16*a*, are readily formed by conventional rolling techniques because of the simplicity of such strips. The strips containing the side walls 14 are fabricated by any of a variety of methods as are shown in FIGS. 11–15.

Figure 11:
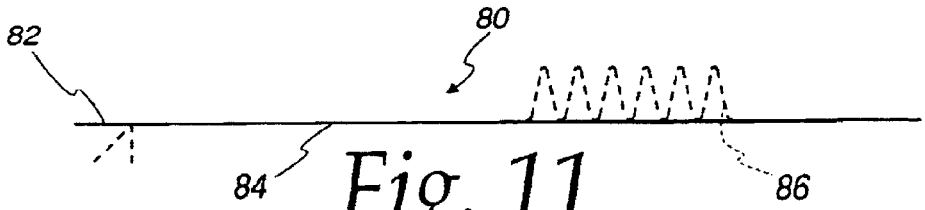
FIGS. 11, 11A and 11B show steps in the sequence in making one type of tube according to the invention.
Figure 11A:
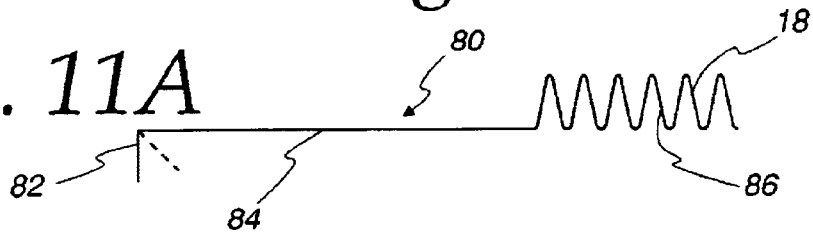

Referring to FIG. 11, an elongated strip having a substantial width is generally designated 80 and includes, from left to right as viewed in FIG. 11, an end wall section 82 for forming the end walls 16 or 16*b*, a side wall section 84 for forming the side wall 14 and a corrugated fin forming section 86 for forming the corrugated fin 18. By appropriate rolling techniques, the strip 80 is first deformed at the fin forming section 86 to provide the corrugated fin 18. If desired, simultaneously therewith, the end wall section 82 may be bent at right angles to the side wall defining section 84 and the result is illustrated in FIG. 11A. It will be noted that the side wall section 84 is located between the end wall section 82 and the fin section 86.

Figure 12:
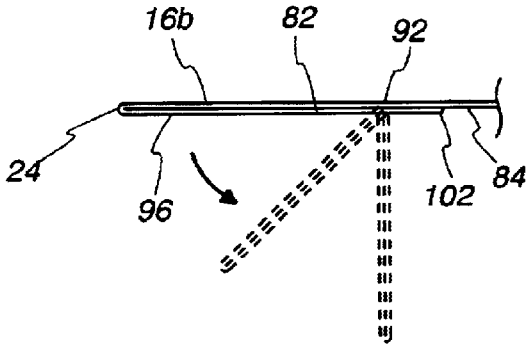
FIG. 12 is an enlarged, fragmentary view of the part shown within the circle 12 in FIG. 11B.
Figure 11B:
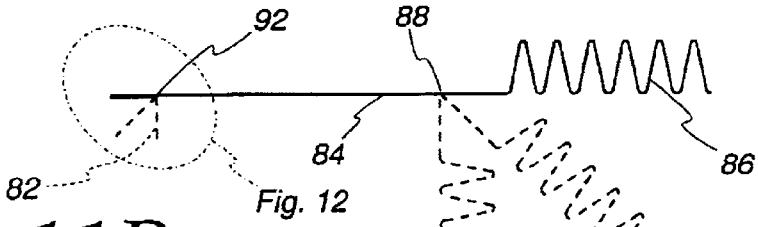
Figure 13:
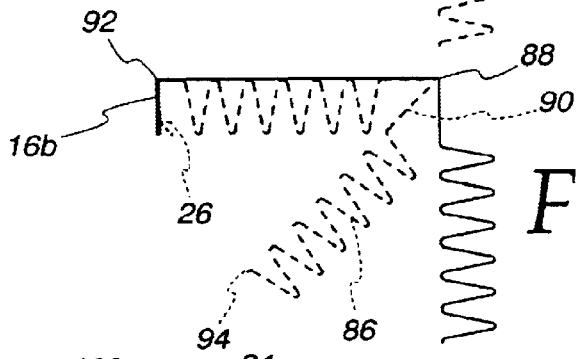
FIGS. 13, 13A, 13B and 13C somewhat schematically illustrate further steps in forming a tube according to the invention.

At a point 88, the strip is then bent to bring the corrugated section 18 around and the crests 32 into abutment with the side wall defining section 84. It is to be noted that an undeformed portion 90 remains on the fin defining section 86 as shown in FIG. 13. The end wall section 82 is doubled upon itself and then the resulting section bent at a point 92 to be at right angles to the side wall section 84 as shown in FIGS. 11B and 12. The dimensioning is such that an end 94 of the corrugated section 86 closely approaches the side wall section 16*b*.

Figure 13A:
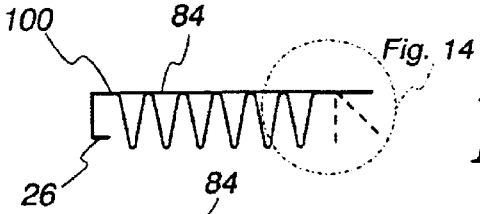

At this point, as shown in FIG. 13A, that area at the bend 24 of the doubled over end wall section 16*b* can be bent at a point 96 to form the reentrant tongue 26.

Figure 14:
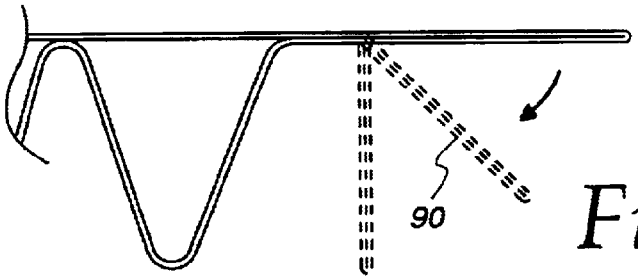
FIG. 14 is an enlarged, fragmentary view of the subject within the circle 14 shown in FIG. 13A.
Figure 13B:
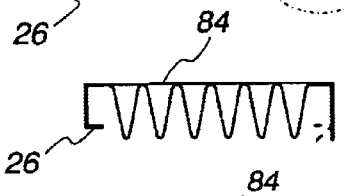
Figure 13C:
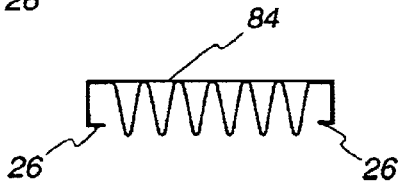

As shown in FIG. 13A, it is then possible to bend the area 90 at right angles to the side wall section 84 as shown in FIGS. 13A and 14 to be at right angles to the side wall section 84 to form the second end wall section 16*b*. At this point, a further bend at the end of the section 90 may be formed to define another one of the reentrant tongues 26 as shown in FIGS. 13B and 13C.

In this embodiment of the invention, a bond or joint 100 is located where the end 94 of the corrugated section 86 abuts an end 102 of the end wall forming section 82.

Figure 15:
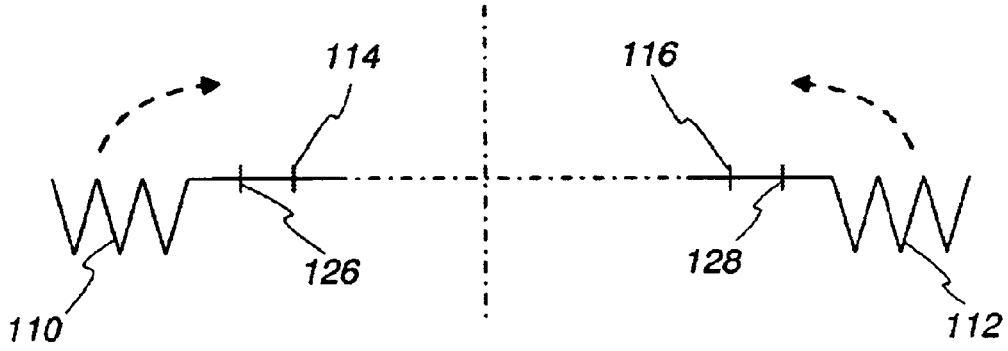
FIGS. 15, 15A, 15B and 15C illustrate a sequence of steps in forming another embodiment of the invention.
Figure 15A:
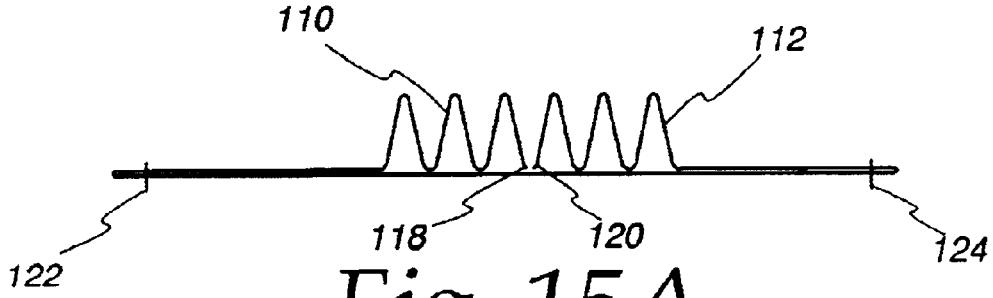
Figure 15B:
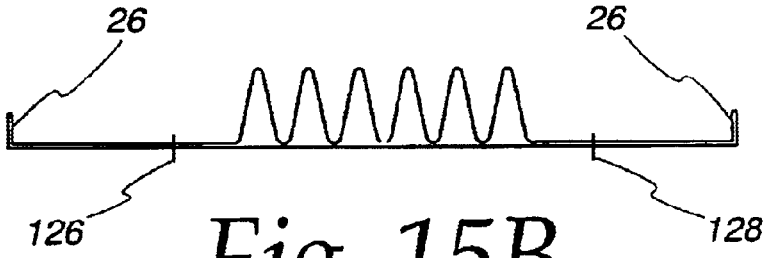
Figure 15C:
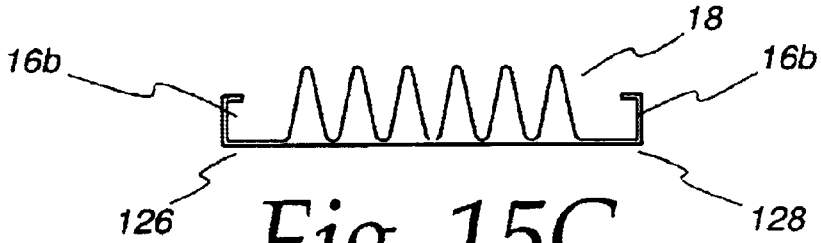

FIGS. 15–15C show an alternate embodiment forming the invention. In this particular embodiment of the invention, two corrugated sections 110 and 112 are formed on opposite ends of the strip. They are first bent at points 114 and 116, respectively, to bring the corrugated sections 110, 112 into the center of the strip so that ends 118, 120, respectively, are in substantial abutment as shown in FIG. 15A to form a joint thereat. The strip may then be bent at points 122, 124, at right angles to the remainder of the strip to form the reentrant tongues 26 as shown in FIG. 15B. A further bend may then be made in both sides of the strip at points 126, 128 to form the side walls 16*b*. The resulting configuration is that shown in FIG. 2A prior to the application of the piece having the side wall 12.

As alluded to previously, it is preferred that the strips, typically 0.15–0.20 mm in thickness, be formed of braze clad aluminum. Consequently, when the two parts are assembled and held in frictional engagement as mentioned previously, they may then be placed in abutment with each other and with the end plates 54 and the tanks 52 as well as the fins 58 in place and then located within a brazing furnace to provide brazing of the components together and, where sealing is required, a sealing of the various joints.

It will therefore be appreciated that a tube made according to the invention is ideal in that it provides a rectangular or oval cross section tube with an internal fin utilizing but two pieces of strip material and eliminates the need for separate insertion of an internal fin. The advantages of an internal fin, namely, pressure resistance, and improved heat transfer, are retained and, where desirable, totally separate flow paths may be formed providing that the bonding at the crests 32 of the internal fin to the side walls 12, 14 is complete along its length. The tubes may be utilized in headerless heat exchangers such as illustrated in FIGS. 4 and 5 or may be employed with conventional headers. In the latter respect, the tube shown in FIGS. 10 and 10A is preferred for the latter application because the convex end walls 16 provide for less turbulent air flow about the tubes between the fins 58, thereby lowering pressure drop and the energy requirements necessary to drive fluid through the fins 58.

The double thickness of the end walls in certain of the embodiments provides improved strength to resist damage from stones or other mechanical forces, particularly when used in a vehicular application.

What is claimed is:

1. In a flattened tube for use in a heat exchanger having two spaced relatively long side walls connected at their ends by two spaced relatively short end walls to provide a generally rectangular or oval-like cross section and an internal fin extending between the side walls within the tube to provide a plurality of internal flow channels within the tube, the improvement wherein the tube includes two pieces, each including a corresponding one of said side walls and at least one of said pieces including at least a portion of each of said end walls with a first of said pieces including an integral corrugated section defining said internal fin and folded back into abutment with the side wall of a second said piece having its side wall abutting said corrugated section opposite of the side wall of said first piece; said pieces being sealingly bonded to each other at said end walls with the side walls of both said pieces being bonded to said corrugated section within said cross section.

2. The flattened tube of claim 1 wherein said pieces are braze clad aluminum, said bonding forms a brazed point and at least one of said pieces includes a mating formation that mates with part of the other of said pieces to hold said pieces together during brazing.

3. The flattened tube of claim 1 wherein both said pieces have portions of said end walls and are bonded to each other at joints located noncentrally in said end walls, said cross section being generally rectangular.

4. The flattened tube of claim 3 wherein said joints are located closer to said second piece side wall than to said first piece side wall.

5. The flattened tube of claim 1 wherein said pieces are bonded to one another by joints located generally centrally of said end walls and said end wall are outwardly convex.

6. The flattened tube of claim 1 wherein said pieces are made of metal strips and said end walls having a thickness double the thickness of said strips.

7. The flattened tube of claim 1 wherein said pieces are made of metal strips and said end walls having a thickness approximately equal to the thickness of said strips.

8. The flattened tube of claim 1 wherein said pieces are bonded to each other by joints, said joints being defined by generally U-shaped formations on one of said pieces and folded edges on the other of said pieces, legs of said U-shaped formations abutting said folded edges.

9. The flattened tube of claim 8 wherein said folded edges are on said first piece and said U-shaped formations are on said second piece.

10. The flattened tube of claim 2 wherein said mating formation includes folded edges on one of said pieces and bent edges on the other of said pieces frictionally engaging said folded edges.

11. The flattened tube of claim 10 wherein said bent edges fit within said folded edges and are located on said second piece.

12. A heat exchanger including a pair of spaced header plates, each of said plates having tube slots aligned with tube slots in the other of said pieces, and a plurality of tubes according to claim 1 and having opposed ends disposed and sealingly bonded in the aligned ones of said tube slots.

13. A heat exchanger including a plurality of tubes according to claim 1 aligned in a row with their side walls facing each in spaced relation; serpentine fins extending between and bonded to the facing side walls of adjacent tubes, each tube, at its ends, having its end walls split with the second piece deflected away from the first piece of the same tube, and with the side wall of each first piece sealingly engaging the deflected end of the second piece of an adjacent tube; and a channel shaped tank fit over and sealingly engaging and bonded to the deflected ends of the second pieces and the end walls of both said pieces from the ends of said tubes to a location where said end walls are not split.

14. A method of making a tube of rectangular or oval cross section and having an internal fin for use in a heat exchanger, comprising the steps of:

(a) providing first and second elongated strips of good thermally conductive material;

(b) forming said first strip to have a flat, tube side wall section, two spaced tube end wall sections and a corrugated section disposed between said side wall section and one of said end wall sections;

(c) bending said first strip to bring said corrugated section into aligned abutment with said first strip side wall section;

(d) locating said second strip on said first strip in abutment with said corrugated section and with said end wall sections; and (e) bonding said second strip to said end wall section in sealed relation, and to said corrugated section.

15. The method of claim 14 wherein step (d) is preceded by the additional step of forming the second strip into a generally central side wall section located between two end wall sections and step (d) is performed by abutting said second strip end wall sections with said first strip end wall sections.

16. The method of claim 14 wherein step (b) includes the step of forming a second corrugated section between said first strip side wall section and the other of said first strip end wall sections, and step (c) is performed on both said corrugated sections.

17. The method of claim 14 wherein the forming of first strip end wall section according to step (b) is accomplished by bending said strip at each edge of said side wall section to approximately a right angle thereto, and at an edge of each end wall section remote from said first strip side wall section, forming a reentrant tongue so that the reentrant tongue on each first strip end wall section are directed toward each other.

18. The method of claim 14 wherein step (d) is preceded by the step of bending opposite edges of said second strip to form retention tongues directed toward said first piece end wall section and step (d) includes fitting said retention tongues in interfering relation to said first strip end wall section prior to the performance of step (e).

19. The method of claim 18 wherein the step of bending opposite edges includes forming an inwardly opening U-shaped formation between said retention tongues and the remainder of said second strip.

20. The method of claim 19 wherein the forming of first strip ed wall section according to step (b) is accomplished by bending said strip at each edge of said side wall section to approximately a right angle thereto, and at an edge of each end wall section remote from said first strip side wall section, forming a reentrant tongue so that the reentrant tongue on each first strip end wall section are directed toward each other, and step (d) includes abutting the legs of said channels remote from said remainder of said second strip against said reentrant tongues and engaging in interference relation, said retention tongues on ends of said reentrant tongues.

21. The method of claim 14 wherein said strips are aluminum and at least one of said strips is braze clad aluminum, and step (e) is performed by brazing.

* * * * *